US005155284A

United States Patent [19]

Flashkes

[11] Patent Number: 5,155,284

[45] Date of Patent: Oct. 13, 1992

[54] MACHINE GUNS BARREL LOCKING MECHANISM

[75] Inventor: Adi Flashkes, Ramat-Hasharon, Israel

[73] Assignee: Israel Military Industries Ltd, Kamat Hasharon, Israel

[21] Appl. No.: 596,374

[22] Filed: Oct. 12, 1990

[30] Foreign Application Priority Data

Oct. 18, 1989 [IL] Israel ..... 92039

[51] Int. Cl.[5] ..... F41A 21/48

[52] U.S. Cl. ..... 42/75.02

[58] Field of Search ..... 42/75.02, 77

[56] References Cited

U.S. PATENT DOCUMENTS 2,163,144 6/1939 Holek ..... 42/75.02
2,423,854 7/1947 Simpson ..... 42/75.02
2,981,154 4/1961 Sweeney ..... 42/75.02
4,016,800 4/1977 Rusbach ..... 42/75.02
4,920,679 5/1990 Sarles et al. ..... 42/75.02

*Primary Examiner*—Richard W. Wendtland

[57] ABSTRACT

A machine gun is provided, which has a detachable barrel. The barrel has a plurality of axially extending outer barrel ridges integral with and projecting from the top of the barrel near its rear end. The body of the machine gun has a barrel catch which is integral with a barrel holding socket and has a chamber adapted to accommodate the barrel ridges reciprocal between locking and unlocking positions. A locking pin is provided, which has a plurality of downward projecting, axially extending body ridges which, together with a stop member, snugly accommodate the barrel ridges when the pin is in the locked position, but intermesh with the barrel ridges in the unlocked position of the pin.

6 Claims, 6 Drawing Sheets

MACHINE GUNS BARREL LOCKING MECHANISM

FIELD OF THE INVENTION

The invention is generally in the fiel machine guns and concerns particularly machine guns with exchangeable barrels.

GLOSSARY

The meanings of some of the terms that will be used in the following description and claims are as follows:

Body—the central part of the machine gun between the butt or stock and the barrel.

Receiver—the major part of the body which houses the slide and the cartridge feeding mechanism.

Receiver cover—a swingable lid which when closed seals the cartridge feeding mechanism.

Breech—a chamber at the rear end of the barrel which is shaped to accommodate a cartridge.

Bolt—an operative member forming part of the slide, and which during the slide's forward movement, pushes a cartridge into the breech. The bolt houses the striker pin and has attached thereto an extractor which is adapted to extract an empty cartridge from the breech after firing.

Barrel extension—a member at the rear end of the barrel in which the bolt is locked during firing of a round. The barrel extension may form an integral part of the barrel or may be part of the body in which case the rear end of the barrel is brought into close proximity therewith. The barrel extension is generally provided with latches which cooperate with bolt members to lock the bolt during firing. The latches in the barrel extension are termed "barrel latches" if the barrel extension forms an integral part of the barrel or "body latches" in case the barrel extension forms part of the body.

BACKGROUND AND OBJECTS OF THE INVENTION

One of the critical features in machine guns is the so-called "headspace" which is the distance between the front face of the bolt and a defined location inside the breech and as a rule, correct headspace must be observed at all times. Incorrect headspace may cause, on one hand, firing failure and on the other hand, if priming of the cartridge is performed while the cartridge is not snugly fitted inside the breech, part of the energy liberated by the explosion of the propellant will dissipate sideways and rearwards, resulting in reduction of the force acting on the bullet emerging from the barrel and consequently of its range and accuracy. Additionally and more importantly, the sidewards and rearwards expanding explosion waves may damage the rifle and sometimes also cause injuries to the gunner.

Machine guns in general, and light machine guns in particular, are designed for high speed, sustained firing. During such firing the barrel heats up considerably which may cause bullet cook-off and at times even irreversible damage, such as the formation of cracks and blow-up. In order to avoid such damages, it is necessary to replace the barrel from time to time during prolonged firing.

A major problem in a machine gun with a replaceable barrel, is the need to ensure that the headspace always remains the same. In some machine guns the distance between the bolt and the barrel is adjusted shortly before firing with the aid of special gauges designed therefor. Obviously such adjustment under field conditions is inconvenient and not within the capability of every soldier. Moreover, experience shows that such field adjustment, even if adequately performed, is not always satisfactory and additionally may change during firing.

In view of these difficulties it is usually the practice today to provide each individual machine gun with a pair of interchangeable barrels, factory adjusted to fit a given machine gun, in order to ensure the correct headspace. However, even this solution is not quite satisfactory and experience shows that under operational stresses mistakes do occur and a barrel intended for use with one machine gun is mistakenly attached to another.

It is an object of the present invention to provide a barrel locking mechanism for a machine gun which ensures accurate adjustment of the barrel inside the body to achieve the desired headspace. It is a further object of the present invention to so design such locking mechanisms that barrels mass-produced for a particular type of machine gun are interchangeable without any restriction.

GENERAL DESCRIPTION OF THE INVENTION

By the present invention there is provided a machine gun, having a body and a detachable barrel and comprising means for holding the rear portion of the barrel in a locked state within a barrel holding socket of the body, which means are characterised by a plurality of axially extending outer barrel ridges integral with and projecting from the top of the barrel near the rear end thereof;

a barrel catch integral with said barrel holding socket having a chamber adapted to accommodate said outer barrel ridges and housing a transversal locking pin reciprocal between locking and unlocking positions and spring-biased into the locking position, which locking pin has a plurality of downward projecting, axially extending body ridges which, when the locking pin is in the locking position abut said outer barrel ridges such that latter are rearward of the former, and when the locking pin is shifted to the unlocking position, intermesh with the barrel ridges; and stop means within the barrel holding socket adapted to arrest the barrel from the rear end so distanced from the rear end of the body ridges to form an interval which in the locked position snugly accommodates the barrel ridges.

For locking the barrel inside the barrel holding socket, the locking pin is first shifted to the unlocking position and the barrel is pushed to the rear until arrested by the stop means. In this position of the barrel, the barrel ridges are positioned rearward of the body ridges and when now the locking pin is allowed to snap into the locking position the barrel is fully locked.

In a preferred embodiment of the invention, the front end of the barrel ridges and the rear ends of the body ridges are slanted in a complementary manner, so that when the two sets of ridges are pushed against one another, a transversal force component of the force of the biasing spring which pushes the locking pin to the locking state, pushes the barrel backwards. Typically such slant is of the order of 3°–7°, and preferably about 5°.

The locking mechanism of the invention is suitable both for machine guns in which the barrel extension is integral with the barrel and machine guns in which the barrel extension is integral with the body.

In accordance with a preferred embodiment of the invention, the barrel locking mechanism further comprises safety means which ensure that the locking pin is not accidentally shifted to the unlocking position during firing. Such safety means may, for example, comprise means which arrest the lateral dislocation of the locking pin in the unlocking state as long as the receiver cover remains closed.

Further features of the present invention will become apparent from the following description of a specific embodiment.

BRIEF DESCRIPTION OF THE DRAWINGS

A specific embodiment of the invention will now be described, by way of example only, with reference to the annexed drawings in which.

DESCRIPTION OF A SPECIFIC EMBODIMENT

Figure 1:
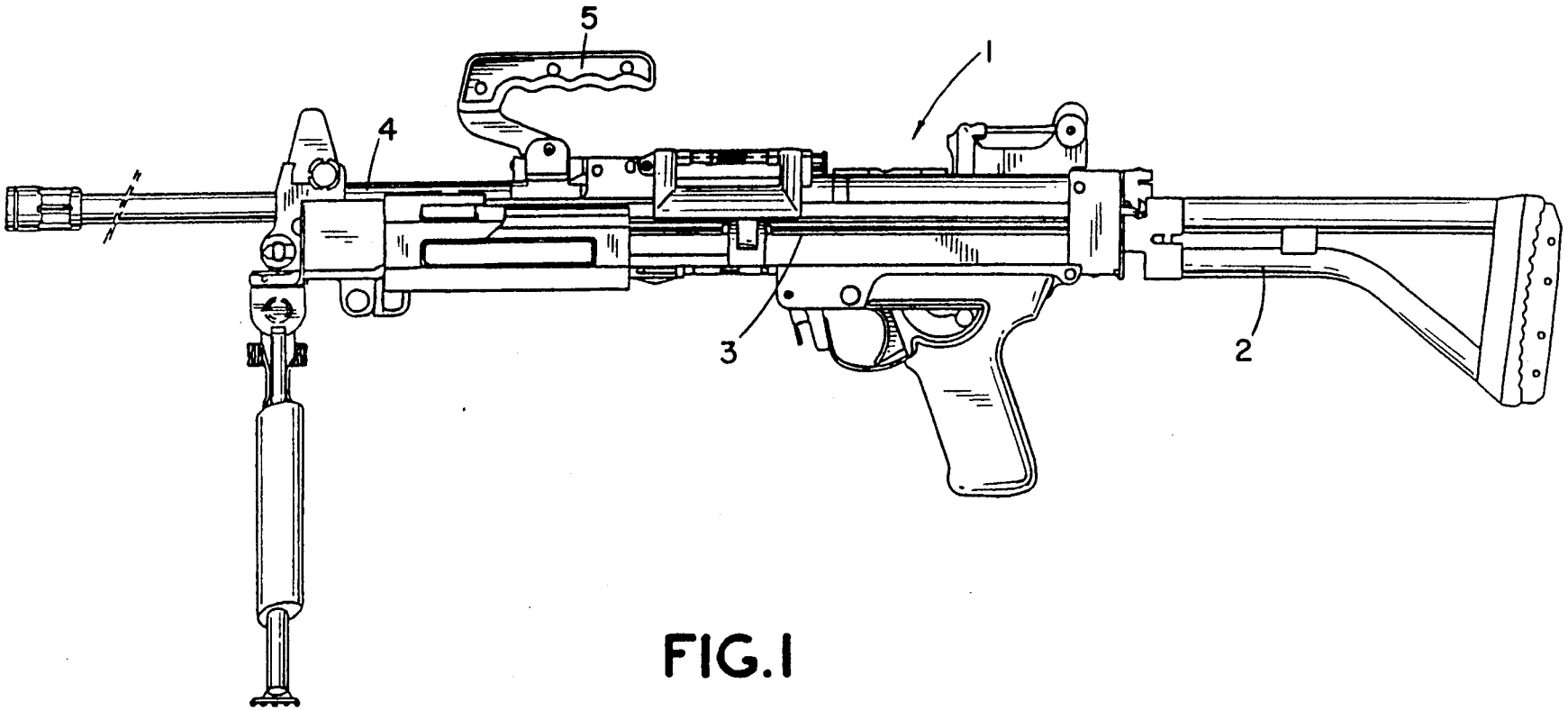
FIG. 1 is a side view of a light machine gun with a locking mechanism according to the present invention.

The light machine gun 1 shown in FIG. 1 comprises a foldable stock 2, a body 3 and a barrel subassembly 4. A carrying handle 5 is attached to the barrel and in addition to enabling the carrying of the machine gun serves for insertion and withdrawal of the barrel.

Figure 2:
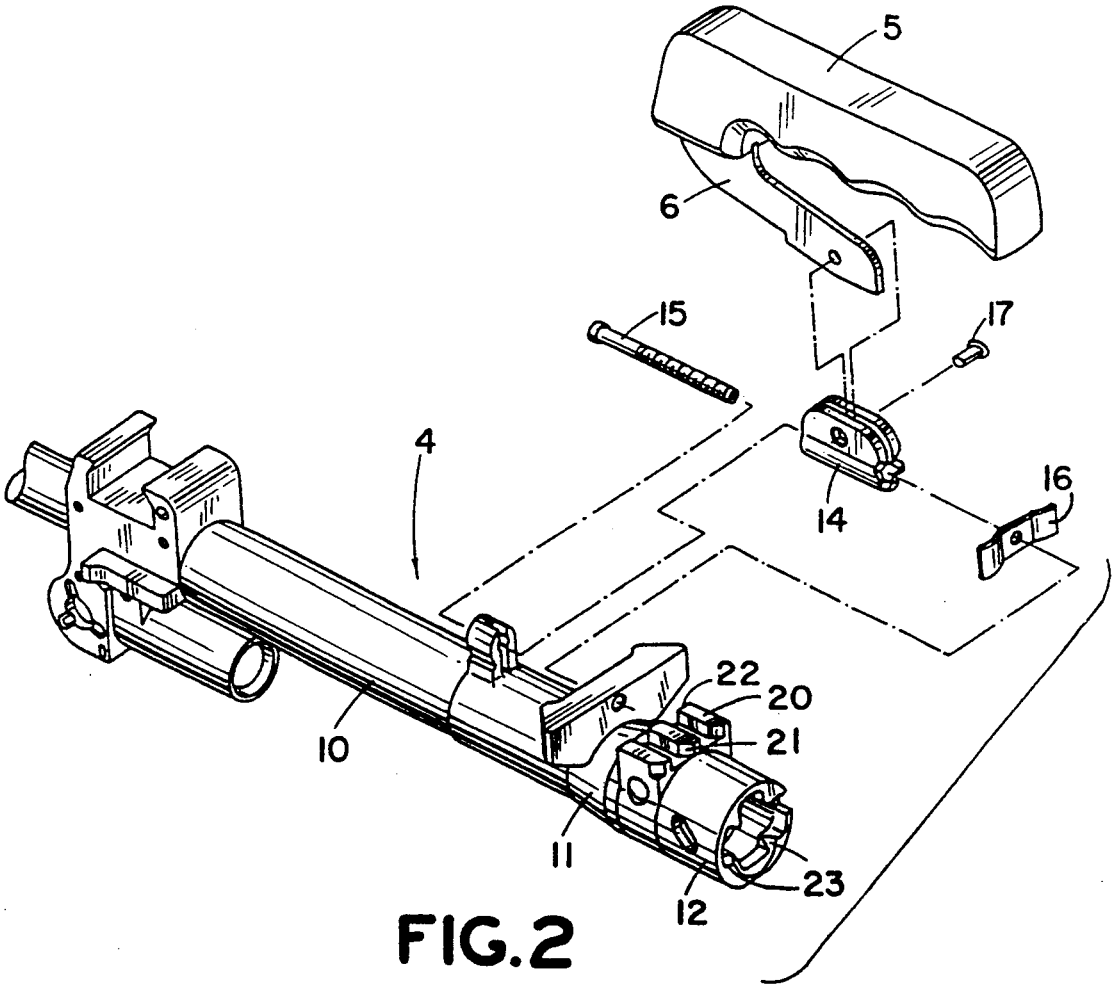
FIG. 2 is a perspective view of the rear end of a barrel subassembly of the machine gun of FIG. 1.

The rear end of the barrel subassembly 4 is shown in an exploded view in FIG. 2. As shown, barrel 10 has near its rear end a tapering breech portion 11 merging into a barrel extension 12. Carrying handle 5 has an integral arm 6 accommodated between lugs 14 swingably mounted on a pivot 15 and cushioned at the rear by a leaf spring 16. Arm 6 is secured to lugs 14 by means of a pin 17.

Figure 4:
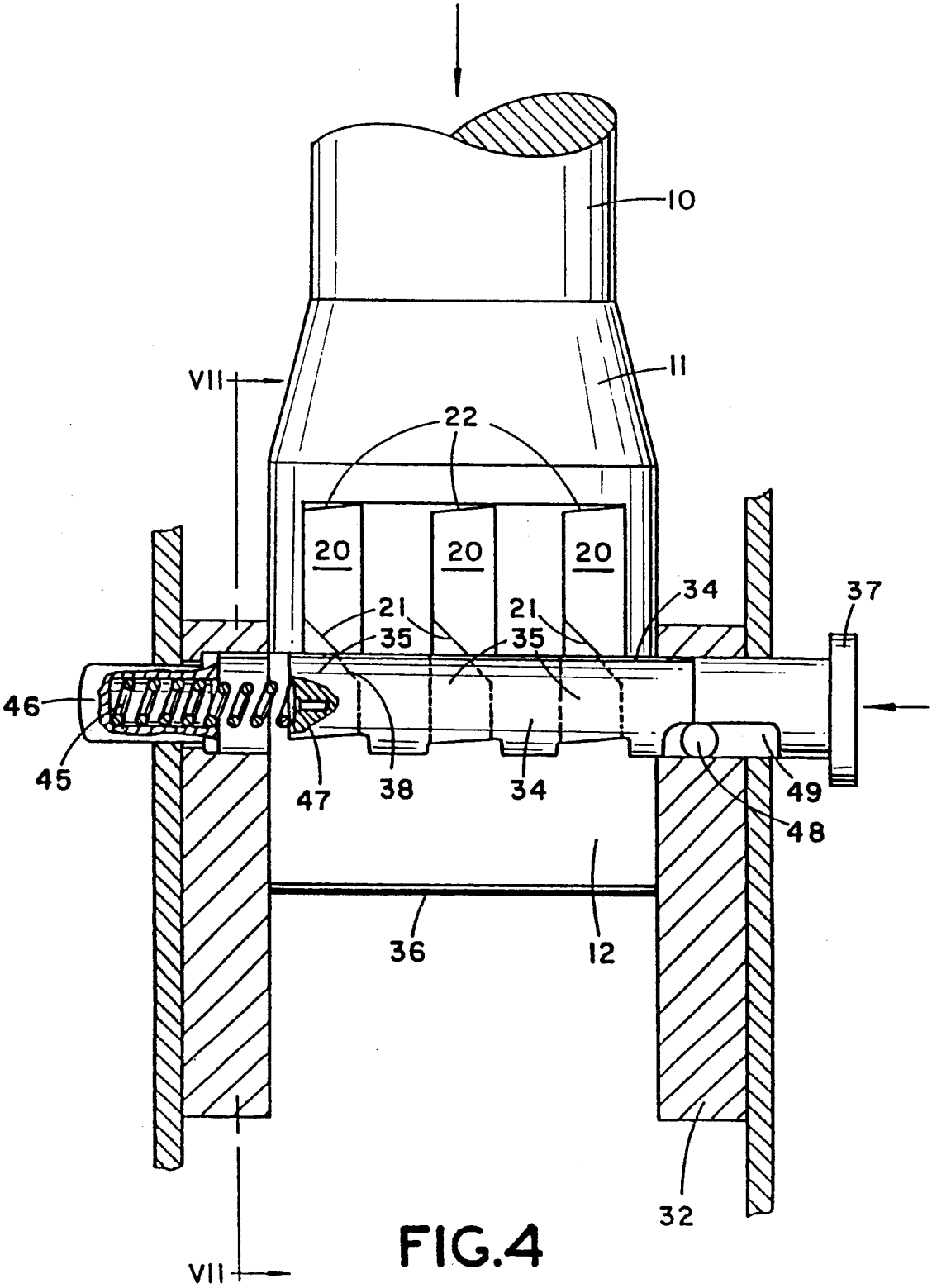
FIGS. 4 to 6 show successive stages in the mounting and locking of the barrel.
Figure 5:
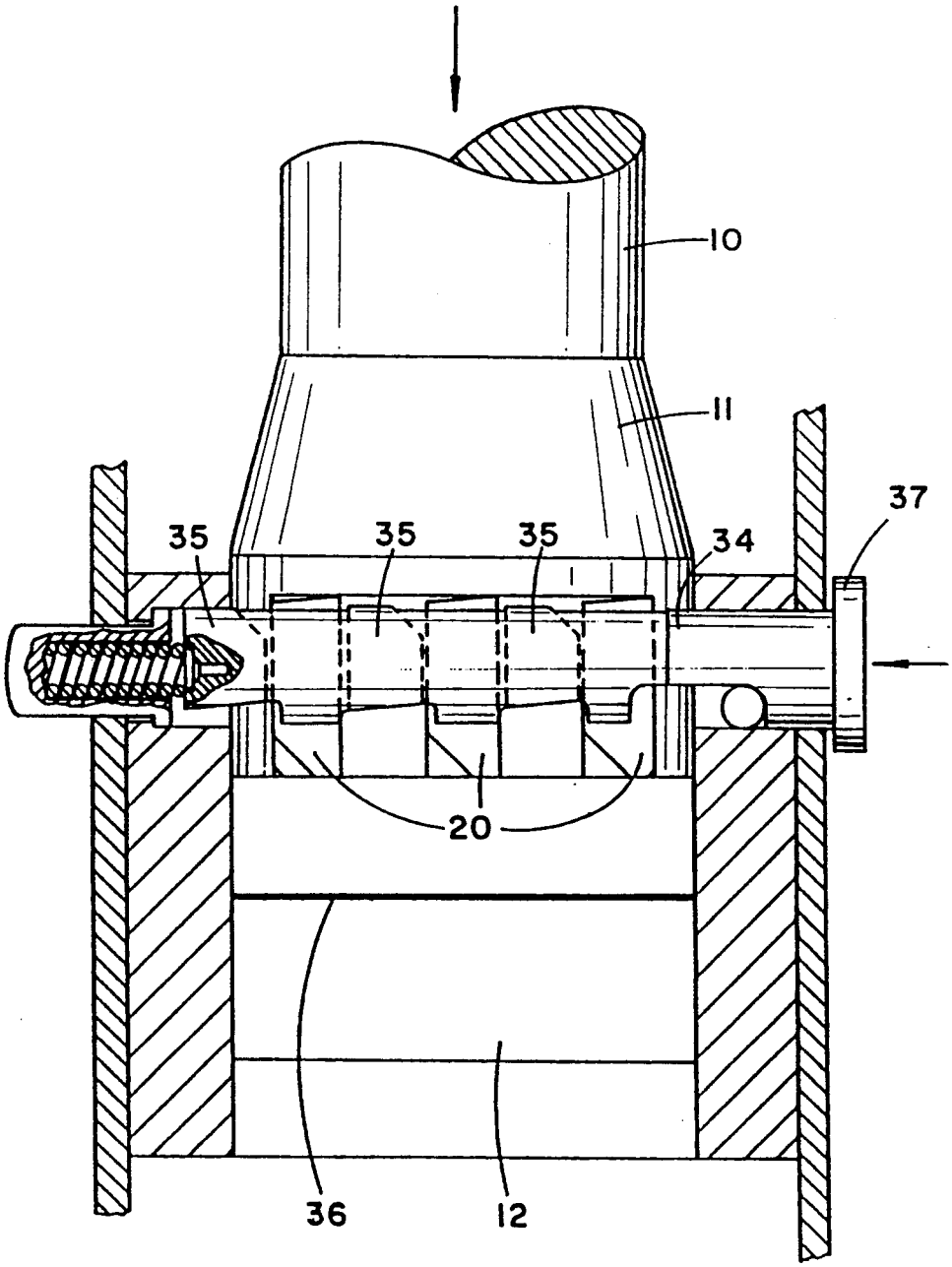
Figure 6:
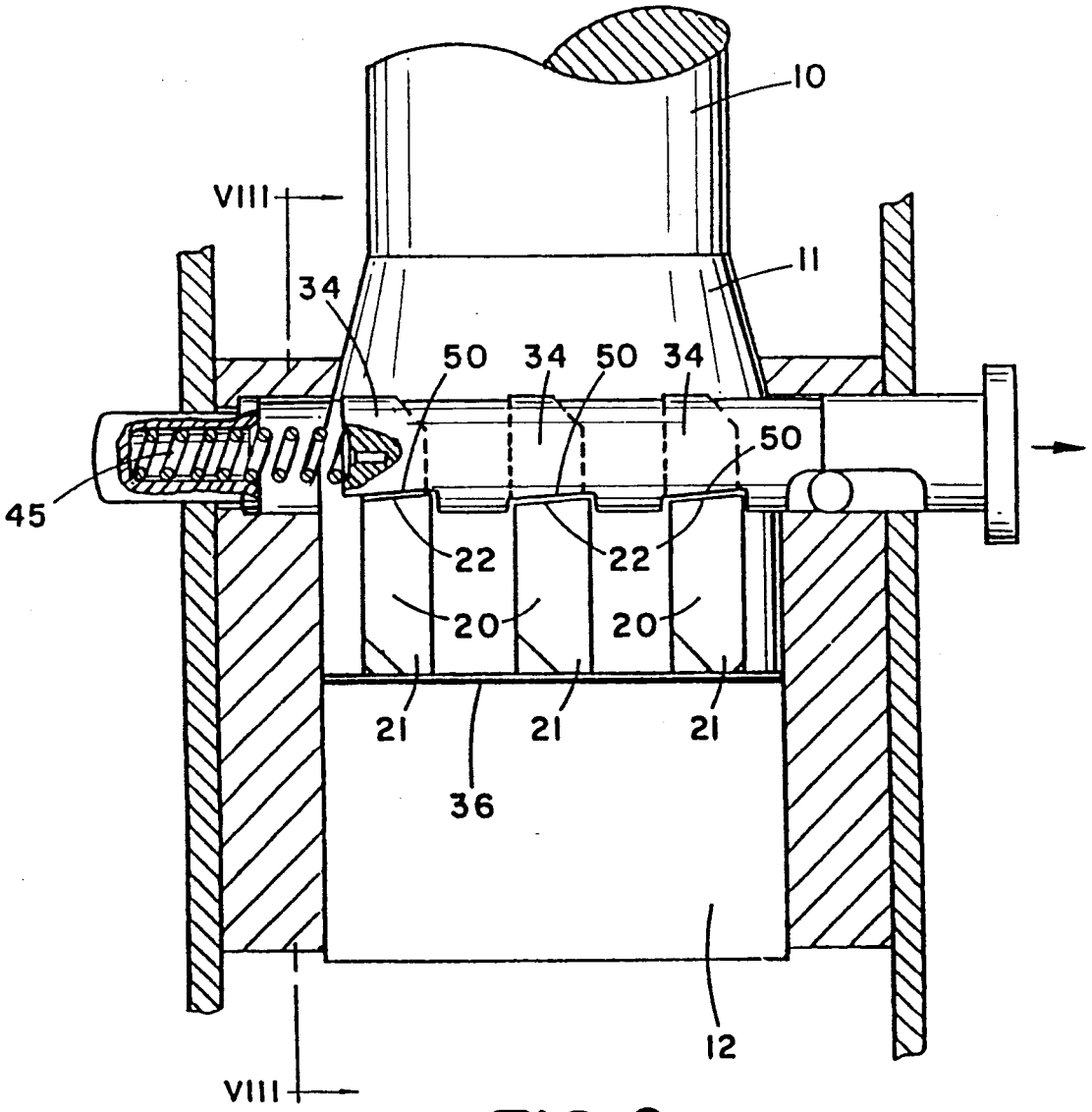

Near its rear end and close to barrel extension 12 barrel 4 comprises three axially extending exterior barrel ridges 20, having chamfered rear ends 21 and slanting front ends 22 (see also FIGS. 4 to 6).

The barrel extension 12 is provided with barrel latches 23 which cooperate with bolt members (not shown) to lock the bolt during firing.

Figure 3:
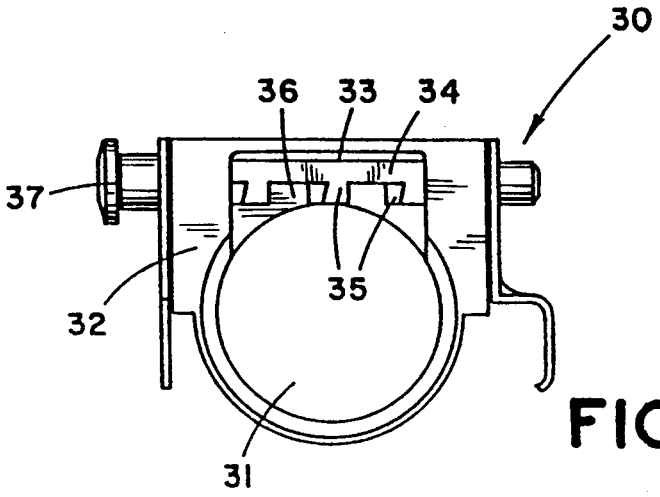
FIG. 3 is a front view of the barrel holding socket and integral barrel catch.

FIG. 3 shows a barrel holding socket aggregate 30 which comprises a cylindrical barrel holding socket 31, a block 32 and a chamber 33 traversed by a transversal locking pin 34 having depending body ridges 35. Chamber 33 comprises at its rear end a transversal stop member 36 (see also FIGS. 4 to 6) so that the distance between the rear face of body ridges 35 and stop member 36 is equal to the length of the barrel ridges 20. Locking pin 34 may be shifted laterally from the locking position shown in FIGS. 3, 4 and 6 to an unlocking position shown in FIG. 5, against the action of a biasing spring 45 (see FIG. 4) by means of pushing knob 37 which is an integral extension of locking pin 34.

The manner in which the barrel is locked inside the aggregate 30 is shown sequentially in FIGS. 4–6. As shown in FIG. 4, at the initial stage the chamfered rear ends 21 of the barrel ridges 20 and the chamfered front ends 38 of the body ridges 35 come to bear on each other. When from this position the barrel is pulled rearwards there results a lateral force component which pushes the locking pin sideways thereby shifting it into the unlocking position against the bias of a spring 45, located within a chamber 46 and having one end anchored in a terminal recess 47 of locking pin 34. The reciprocation of the locking pin is limited by a pin 48 cooperating with a cutout 49 of locking pin 34.

In FIG. 5, the locking pin is shown in the unlocking position, in which barrel lugs 20, are free to move rearward through the valleys between the body ridges 35. The lined, locked state is shown in FIG. 6. In this state the rear ends 21 of the barrel ridges 20 abut stop member 36 and the locking pin 34 snaps into the locking state by the action of biasing spring 45. In consequence, barrel ridges 20 are snugly accommodated in the interval between stop member 36 and abuts the rear ends 50 of the body ridges 35.

As further shown in FIGS. 4 to 6, the rear ends 50 of each body ridges 35 and the front ends 22 of each barrel ridges 20 are slanted in a complementary fashion (about 5° in the embodiment shown) which produces a wedge effect by which the barrel and body ridges are biased against each other.

Figure 7:
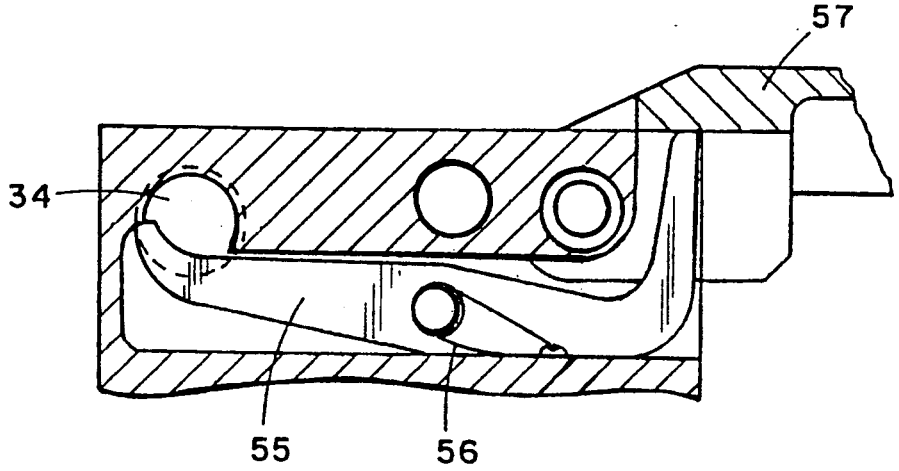
FIG. 7 is a section along line VII—VII of FIG. 4 with the receiver cover opened.
Figure 8:
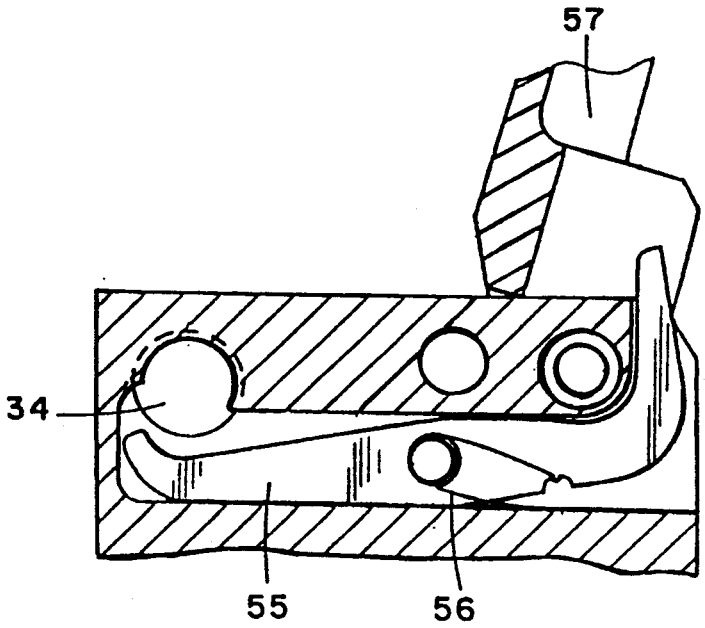
FIG. 8 is a section along line VIII—VIII in FIG. 6 with the receiver cover closed.

In FIGS. 7 and 8 there are shown locking safety means provided in accordance with a preferred embodiment of the invention. It consists of a lever 55, which is biased into the open state shown in FIG. 8 by means of a helical spring 56. During firing, when the receiver cover 57 is closed, lever 55 is retained in the depressed position of FIG. 7 in which it blocks locking pin 34 and prevents it from being shifted into the unlocking state.

Due to the design of the locking mechanism according to the invention, there is no need to tailor a barrel for a specific specimens of a machine gun as any mass produced barrel designed to fit a particular type of machine gun may be used.

What is claimed is:

1. A machine gum comprising a body, a detachable barrel having a rear portion, and means for holding the rear portion of the barrel in a locked state within a barrel holding socket of the body, said means including a plurality of axially extending outer barrel ridges integral with and projecting from a top of the barrel near a rear end thereof;

a barrel catch integral with said barrel holding socket having a chamber adapted to accommodate said outer barrel ridges and housing a transversal locking pin reciprocable between locking and unlocking positions and spring-biased into the locking position, said locking pin having a plurality of downward projecting, axially extending body ridges which, when the locking pin is in the locking position, abut said outer barrel ridges such that the barrel ridges are rearward of the body ridges, and when the locking pin is shifted to the unlocking position, the body ridges intermesh with the barrel ridges; and stop means within the barrel holding socket adapted to arrest the barrel from the rear end so distanced from rear ends of the body ridges to form an interval which in the locked state snugly accommodates the barrel ridges.

2. A machine gun according to claim 1, wherein front ends of the barrel ridges and the rear ends of the body ridges are slanted complementarily with each other such that when the rear portion of the barrel is held in the barrel holding socket in the locked state the front ends of the barrel ridges are parallel to the rear ends of the body ridges.

3. A machine gun according to claim 1 comprising a barrel extension which is integral with the barrel.

4. A machine gun according to claim 1, and further comprising a barrel extension which is integral with the body.

5. A machine gun according to claim 1, and further comprising safety means for arresting the locking pin in the locking position.

6. A machine gun according to claim 5, wherein said safety means comprises a lever swingable between a depressed position and a raised position and biased into the raised position, said lever arresting the locking pin when in the depressed position and being adapted to cooperate with a receiver cover in such a fashion that the lever is retained in the depressed position when the receiver cover is closed.

* * * * *